US010815837B2

(12) United States Patent
Liu et al.

(10) Patent No.: US 10,815,837 B2
(45) Date of Patent: Oct. 27, 2020

(54) VALVE MECHANISM, ENGINE AND VEHICLE

(71) Applicant: GREAT WALL MOTOR COMPANY LIMITED, Baoding, Hebei (CN)

(72) Inventors: Tao Liu, Baoding (CN); Fabao Yang, Baoding (CN); Ji Yin, Baoding (CN); Jiajia Hu, Baoding (CN); Liming Xu, Baoding (CN); Song Zhang, Baoding (CN); Luping Liu, Baoding (CN); Yanlong Fang, Baoding (CN); Lei Wang, Baoding (CN)

(73) Assignee: GREAT WALL MOTOR COMPANY LIMITED, Baoding (CN)

( * ) Notice: Subject to any disclaimer, the term of this patent is extended or adjusted under 35 U.S.C. 154(b) by 0 days.

(21) Appl. No.: 16/620,613

(22) PCT Filed: Jun. 7, 2018

(86) PCT No.: PCT/CN2018/090302
§ 371 (c)(1),
(2) Date: Dec. 9, 2019

(87) PCT Pub. No.: WO2018/224018
PCT Pub. Date: Dec. 13, 2018

(65) Prior Publication Data

US 2020/0165941 A1 May 28, 2020

(30) Foreign Application Priority Data

Jun. 9, 2017 (CN) ..... 2017 1 0433472

(51) Int. Cl.
*F01L 1/18* (2006.01)
*F01L 1/053* (2006.01)
*F01M 9/10* (2006.01)

(52) U.S. Cl.
CPC ..... *F01L 1/053* (2013.01); *F01M 9/101* (2013.01); *F01M 9/105* (2013.01); *F01L 1/185* (2013.01); *F01L 2001/0537* (2013.01)

(58) Field of Classification Search
CPC . F01L 1/053; F01L 1/185; F01L 1/047; F01L 1/18; F01L 2001/0537; F01M 9/10; F01M 9/101; F01M 9/105
See application file for complete search history.

(56) References Cited

U.S. PATENT DOCUMENTS 5,913,293 A * 6/1999 Ochiai ..... F01M 9/105 123/90.33

FOREIGN PATENT DOCUMENTS

CN 206889041 U 1/2018

OTHER PUBLICATIONS

International Search Report dated Aug. 30, 2018 in corresponding International application No. PCT/CN2018/090302; 4 pages.

* cited by examiner

*Primary Examiner* — Zelalem Eshete
(74) *Attorney, Agent, or Firm* — Maier & Maier, PLLC

(57) ABSTRACT

A valve mechanism includes a valve, a camshaft, a fixed support, an intermediate swing arm and a supporting base. The fixed support is provided with a connecting-portion via hole running from top to bottom, two oil passages are defined in a connecting portion, and each of the oil passages is connected with the connecting-portion via hole and a corresponding intermediate swing arm shaft hole. The supporting base defines first and second oil feeding passages therein, the first supporting-base oil feeding passage is communicated with the connecting-portion via hole, and an upper end of the second supporting-base oil feeding passage (Continued)

extends to a base-body camshaft supporting portion of the supporting base. An engine and a vehicle are also provided.

20 Claims, 7 Drawing Sheets

VALVE MECHANISM, ENGINE AND VEHICLE

CROSS-REFERENCE TO RELATED APPLICATION

The present application claims priority to Chinese Patent Application Serial No.201710433472X, entitled "Valve Mechanism, Engine and Vehicle", filed by the Great Wall Motor Company Limited on Jun. 9, 2017.

FIELD

The present application relates to a field of vehicle manufacture, and particularly to a valve mechanism, an engine having the valve mechanism and a vehicle having the engine.

BACKGROUND

In the related art, an oil passage is provided in a valve mechanism of an engine, and lubricating oil may cool and lubricate a cam on a camshaft of the valve mechanism through the oil passage. Since the camshaft is located above a cylinder head of the engine, the oil passage leading to the cam is difficult to arrange, and has a complicated design, a long distance and a relative large loss of pressure of engine oil, and a friction surface may not be supplied with enough oil in time after the engine is started, which causes difficulty in cooling and lubricating the cam.

SUMMARY

In view of this, the present application is intended to propose a valve mechanism which can better meet the cooling and lubricating requirements of a part at least to some extent.

To achieve the above-mentioned objective, the present application provides the technical solution as follows.

A valve mechanism includes a valve, a camshaft, a fixed support, an intermediate swing arm and a supporting base. The valve has a valve roller, and the camshaft is provided with a cam. The fixed support includes a fixed portion and a connecting portion, the connecting portion is connected with the fixed portion, and provided with a connecting-portion via hole running from top to bottom, and the connecting portion defines an oil passage therein. The intermediate swing arm is located between the cam and the valve, and the cam drives the valve to move by means of the intermediate swing arm which swings around an intermediate swing arm shaft mounted in the fixed portion. The oil passage is connected with the connecting-portion via hole, and configured to convey lubricating oil to the intermediate swing arm shaft. The supporting base includes a base body and a base-body camshaft supporting portion configured to support the camshaft. The supporting base defines a first supporting-base oil feeding passage and a second supporting-base oil feeding passage therein, the first supporting-base oil feeding passage is communicated with the connecting-portion via hole, and an upper end of the second supporting-base oil feeding passage extends to the base-body camshaft supporting portion, so as to output the lubricating oil to the camshaft.

Further, a bottom surface oil passage is defined in a bottom surface of the supporting base and communicated with the first supporting-base oil feeding passage and the second supporting-base oil feeding passage.

Further, the bottom surface oil passage includes a first bottom surface oil passage and a second bottom surface oil passage, the first bottom surface oil passage has an inlet end connected with a lower end of the second supporting-base oil feeding passage and an outlet end connected with the first supporting-base oil feeding passage, and the second bottom surface oil passage has an inlet end adapted to be communicated with a cylinder head oil passage and an outlet end communicated with the lower end of the second supporting-base oil feeding passage.

Further, the first bottom surface oil passage is configured as a limiting oil passage with respect to the second bottom surface oil passage.

Further, the first bottom surface oil passage is configured as a stepped limiting oil passage with a decreasing flow section, and has a gradually smaller flow section when nearing the first supporting-base oil feeding passage.

Further, the base body is provided with a base-body via hole therein, and the base body is adapted to be fixed on a cylinder head of an engine by a bolt passing through the base-body via hole. The base-body via hole includes a first base-body via hole aligned with the connecting-portion via hole, such that the fixed support and the supporting base are fixed on the cylinder head by passing a bolt through the connecting-portion via hole and the first base-body via hole successively. A gap between the first base-body via hole and the bolt passing through the first base-body via hole serves as the first supporting-base oil feeding passage, and the connecting-portion via hole is in clearance fit with the bolt.

Further, the base-body via hole further includes a second base-body via hole, a camshaft gland is provided on the supporting base, the camshaft is supported cooperatively by the camshaft gland and the base-body camshaft supporting portion, supporting base is adapted to be fixed on the cylinder head by passing another bolt through the camshaft gland and the second base-body via hole, and a gap between the second base-body via hole and the bolt serves as the second supporting-base oil feeding passage.

Further, two fixed portions are provided and connected with each other by the connecting portion, the fixed portion defines an intermediate swing arm shaft hole therein, and the intermediate swing arm shaft is mounted in the intermediate swing arm shaft hole; two oil passages are provided, each of the two oil passages is located above the corresponding intermediate swing arm shaft hole, and the two oil passages are arranged obliquely relative to the connecting-portion via hole.

Further, the connecting portion has a front surface and a rear surface, the front surface of the connecting portion is provided with a spring limiting plate extending forwards, and a spring limiting groove is defined between the spring limiting plate and the front surface of the connecting portion, open downwards and closed by an upper surface of the supporting base.

Further, the connecting portion is connected between top surfaces of the two fixed portions, the two fixed portions are spaced apart axially, and the supporting base is located between the two fixed portions.

Compared with the related art, the valve mechanism according to the present application has the following advantages.

1) With the valve mechanism according to the present application, by providing the first supporting-base oil feeding passage and the second supporting-base oil feeding passage, the lubricating oil may flow to the intermediate swing arm shaft through the first supporting-base oil feeding passage and to the camshaft through the second supporting-base oil feeding passage, thereby lubricating the intermediate swing arm shaft and the camshaft, and guaranteeing smooth work of the valve mechanism.

2) With the valve mechanism according to the present application, by configuring the first bottom surface oil passage as the stepped limiting oil passage with the decreasing flow section and to have the gradually smaller flow section when nearing the first supporting-base oil feeding passage, the lubricating oil which flows into the first supporting-base oil feeding passage may have a relatively high flowing pressure, and is guaranteed to have a sufficient pressure to flow to a junction between the oil passage and the first supporting-base oil feeding passage.

3) With the valve mechanism according to the present application, by providing each oil passage above the intermediate swing arm shaft hole correspondingly, and arranging the two oil passages obliquely relative to the connecting-portion via hole, the lubricating oil may flow more smoothly to the intermediate swing arm shaft hole from the connecting-portion via hole under its own gravity.

Another objective of the present application is to propose an engine including any one of the above-mentioned valve mechanisms.

In the engine according to the present application, normal work of the engine is facilitated by providing the valve mechanism.

Another objective of the present application is to propose a vehicle including the above-mentioned engine.

In the vehicle according to the present application, normal travel of the vehicle is facilitated by providing the engine.

BRIEF DESCRIPTION OF THE DRAWINGS

The accompanying drawings which constitute a part of the present application serve to provide a further understanding of the present application, and exemplary embodiments of the present application and explanation thereof are used for interpreting the present application, without limiting the present application improperly. In the drawings.

REFERENCE NUMERALS

Figure 1:
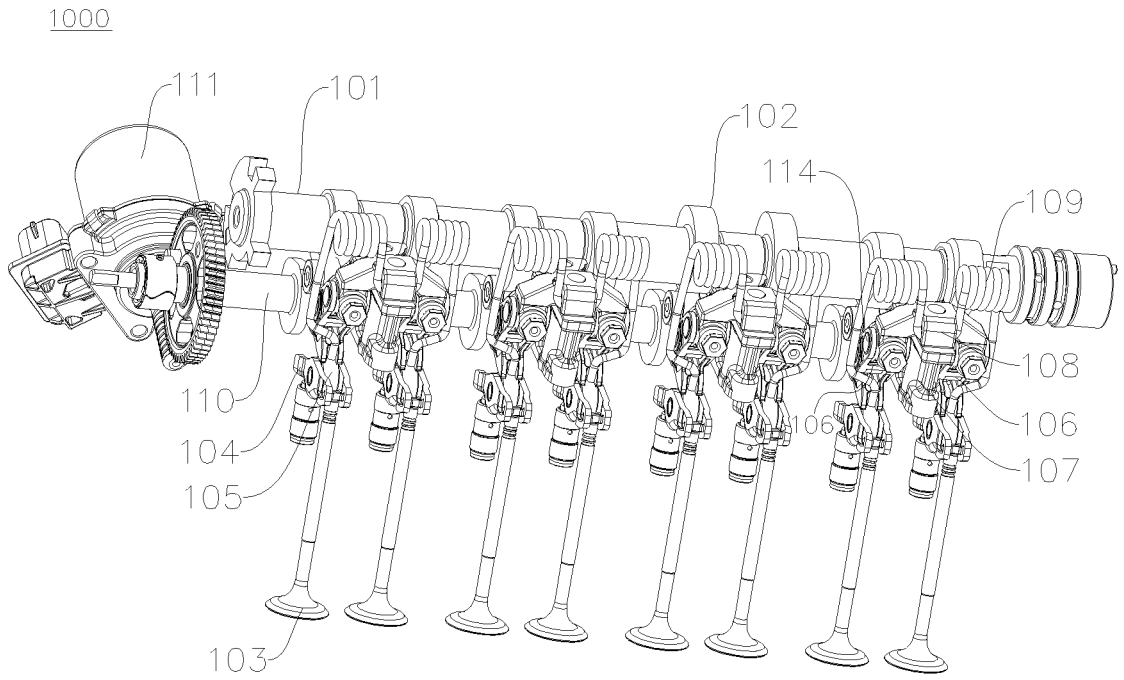
FIG. 1 is a schematic structural diagram of a valve mechanism according to an embodiment of the present application.

1000—valve mechanism; 101—camshaft; 102—cam; 103—valve; 104—valve rocker; 105—valve roller; 106—intermediate swing arm; 107—supporting base; 108—fixed support; 109—elastic restoring device; 110—lift regulating shaft; 111—drive motor; 112—roller assembly; 113—lift regulating eccentric wheel; 114—intermediate swing arm shaft; 115—intermediate swing arm roller; 116—camshaft gland; 117—cylinder head; 201—connecting portion; 202—fixed portion; 203—intermediate swing arm shaft hole; 204—connecting-portion via hole; 205—oil passage; 206—spring limiting plate; 207—spring limiting groove; 208—limiting plane; 301—base body; 302—base—body camshaft supporting portion; 303—second supporting—base oil feeding passage; 304—first supporting—base oil feeding passage; 305—first bottom surface oil passage; 306—second bottom surface oil passage; 401—cylinder head oil passage.

DETAILED DESCRIPTION

It should be noted that the embodiments in the present application and features therein may be combined mutually in the case of no conflicts.

The present application will be described in detail below with reference to the drawings in conjunction with the embodiments.

The valve mechanism 1000 will be described in detail below with reference to FIGS. 1 to 7.

The valve mechanism may include a valve 103, an intermediate swing arm 106, a valve lift regulating mechanism (a lift regulating shaft 110, a lift regulating eccentric wheel 113 and a drive motor 111), a camshaft 101, or the like. The valve mechanism 1000 may be configured to control an intake valve to be opened and closed.

As shown in FIG. 1, a valve rocker 104 is provided at a top of the valve 103, and a valve roller 105 is rotatably provided on the valve rocker 104. The valve 103 may move up and down along a center line thereof to open or close an air inlet in a cylinder head 117. The intermediate swing arm 106 is provided between the valve 103 and the camshaft 101, and a bottom of the intermediate swing arm 106 has a drive profile attached to the valve roller 105.

An intermediate swing arm roller 115 is provided in a middle of the intermediate swing arm 106, and an intermediate swing arm shaft 114 passes through a top of the intermediate swing arm 106, is fixed in a fixed support 108, and may be in interference fit with the fixed support 108 or regulated back and forth relative to the fixed support 108 (in a direction perpendicular to the camshaft 101).

Figure 2:
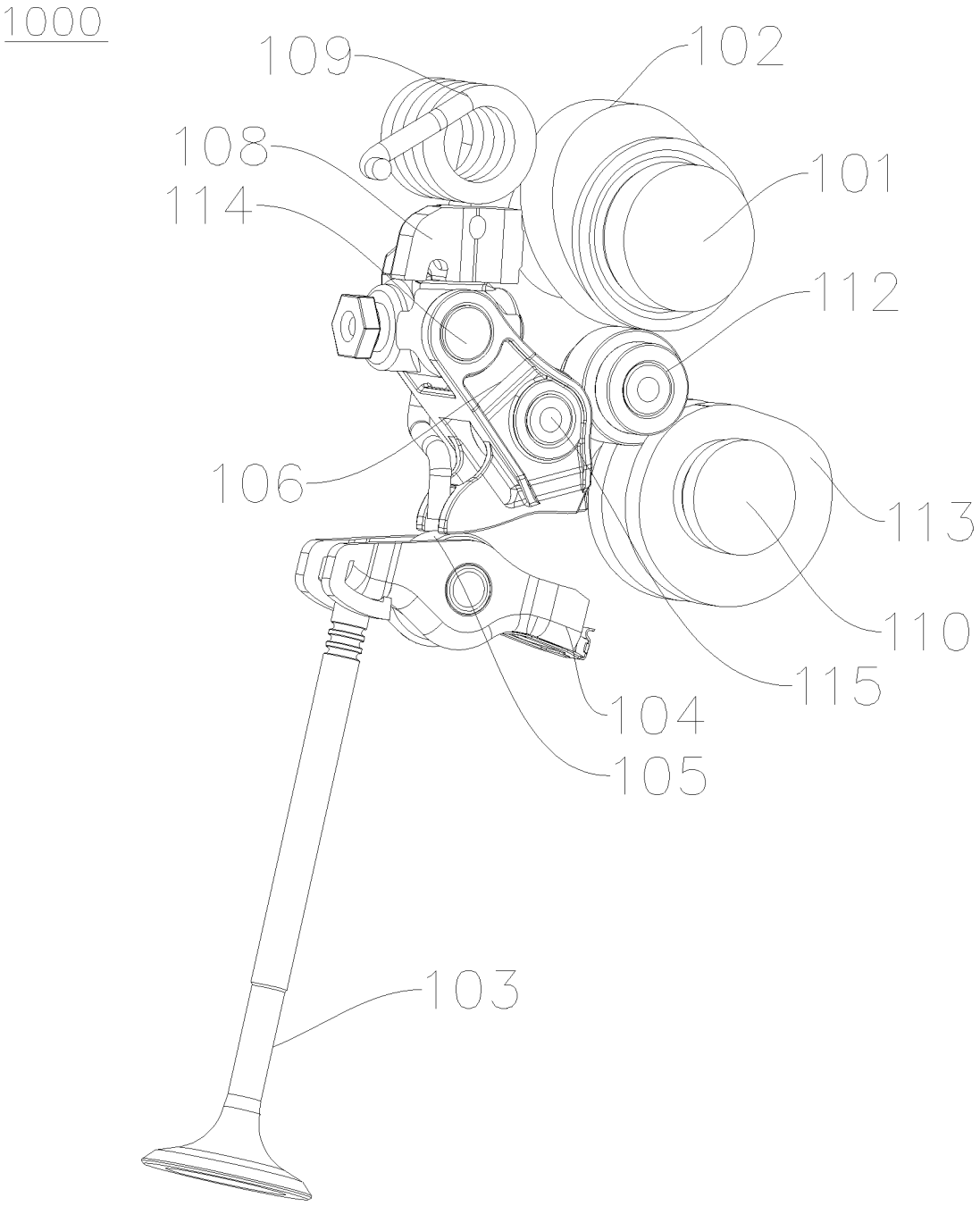
FIG. 2 is a schematic diagram showing a principle of lift regulation of a valve according to an embodiment of the present application.

As shown in FIG. 2, the camshaft 101 has a cam 102, and the cam 102, the lift regulating eccentric wheel 113 and the intermediate swing arm roller 115 share and position a roller assembly 112.

A supporting base 107 is fixed on the cylinder head 117, and the fixed support 108 is fixed on the supporting base 107 and also configured to fix an elastic restoring device 109. The elastic restoring device 109 is configured to supply an elastic restoring force to the intermediate swing arm 106, such that the cam 102, the lift regulating eccentric wheel 113 and the intermediate swing arm roller 115 are attached and in contact all the time.

The valve lift regulating mechanism includes a lift regulating shaft 110, a lift regulating eccentric wheel 113 and a drive motor 111, and configured to regulate a contact position between the drive profile at the bottom of the intermediate swing arm 106 and the valve roller 105.

When the valve mechanism 1000 is operating, the cam 102 rotates with the camshaft 101 and periodically drives the intermediate swing arm 106 to swing around the intermediate swing arm shaft 114, and the drive profile at the bottom of the intermediate swing arm 106 drives the valve roller 105 to enable the valve 103 to move downwards along the center line of the valve, thereby opening the air inlet in the cylinder head 117 to realize air admission. The valve 103 may be restored through a valve spring, and the intermediate swing arm 106 may be restored through the elastic restoring device 109.

When a lift of the valve is required to be regulated, the drive motor 111 drives the lift regulating shaft 110 to rotate clockwise or anticlockwise. Thus, the lift regulating shaft 110 drives the lift regulating eccentric wheel 113 to rotate. Since the lift regulating eccentric wheel 113 is eccentric relative to the lift regulating shaft 110, the lift regulating eccentric wheel 113 drives the intermediate swing arm 106 to swing around an axis of the intermediate swing arm shaft 114 at a small angle by means of the roller assembly 112, thereby changing the contact position between the drive profile of the intermediate swing arm 106 and the valve roller 105, and then variably regulating the lift of the valve continuously.

Figure 3:
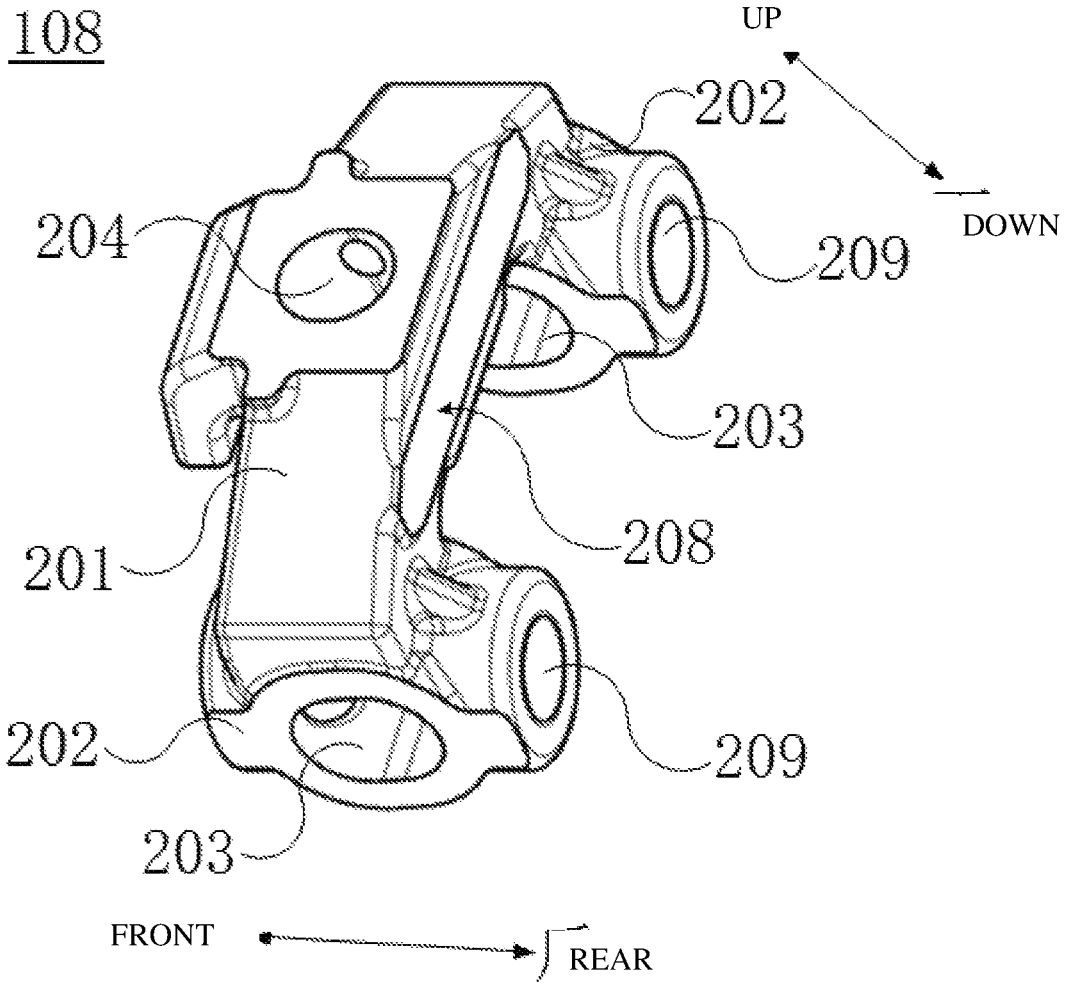
FIG. 3 is a schematic structural diagram of a fixed support according to an embodiment of the present application.

As shown in FIG. 3, the fixed support 108 may include a connecting portion 201 and a fixed portion 202. In one example, two fixed portions 202 may be provided, the fixed portions 202 may be provided with respective intermediate swing arm shaft holes 203 therein, the intermediate arm shaft holes 203 of the two fixed portions 202 may correspond to each other, and each intermediate swing arm shaft hole is fixedly provided with one intermediate swing arm shaft 114 therein.

Figure 7:
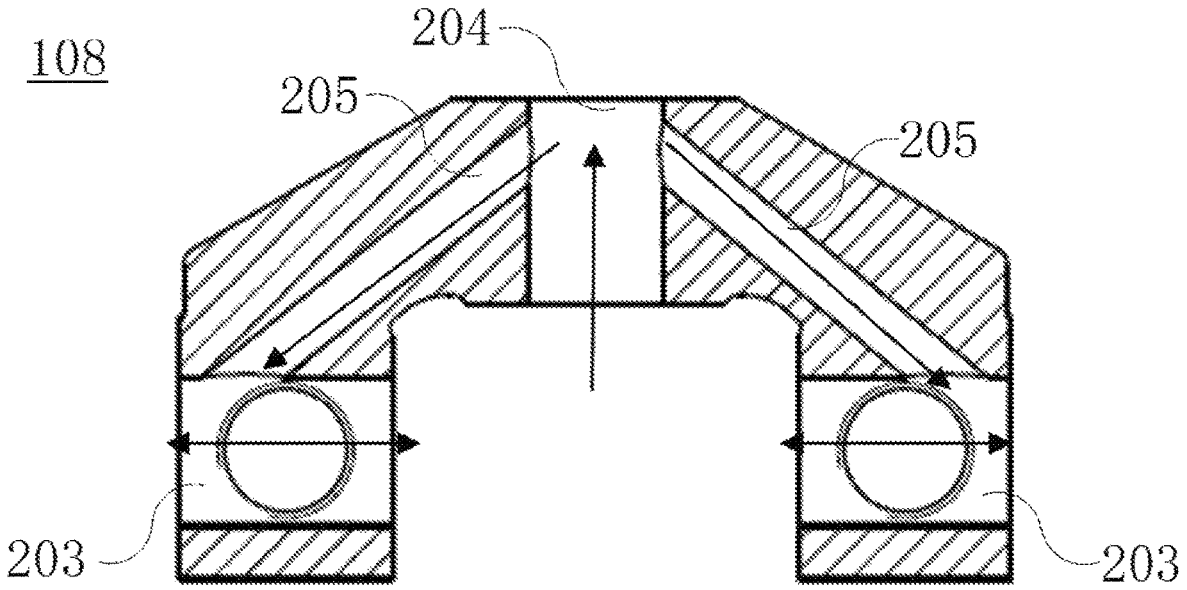
FIG. 7 is a schematic diagram of an internal structure of a fixed support according to an embodiment of the present application.

As shown in FIGS. 3 and 7, the two fixed portions 202 may be connected with each other by the connecting portion 201, the connecting portion 201 may be provided with a connecting-portion via hole 204 running from top to bottom, and a bolt may passes through the connecting-portion via hole 204 from top to bottom, and then is connected threadedly with the cylinder head 117 below the fixed support 108, thereby fixing the fixed support 108 and the cylinder head 117 (the bolt may also passes through the supporting base 107 located between the fixed support 108 and the cylinder head 117).

As shown in FIG. 7, two oil passages 205 may be defined in the connecting-portion 201, each of the oil passages 205 may be connected with the connecting-portion via hole 204 and the corresponding intermediate swing arm shaft hole 203. Thus, the lubricating oil may flow upwards through a gap between the connecting-portion via hole 204 and the bolt therein under the action of a lubricating oil pump, and further flow into the intermediate swing arm shaft holes 203 through the two oil passages 205 respectively, thereby cooling and lubricating the intermediate swing arm shaft 114, guaranteeing normal work of the intermediate swing arm 106, and prolonging the service life of the valve mechanism 1000.

Figure 4:
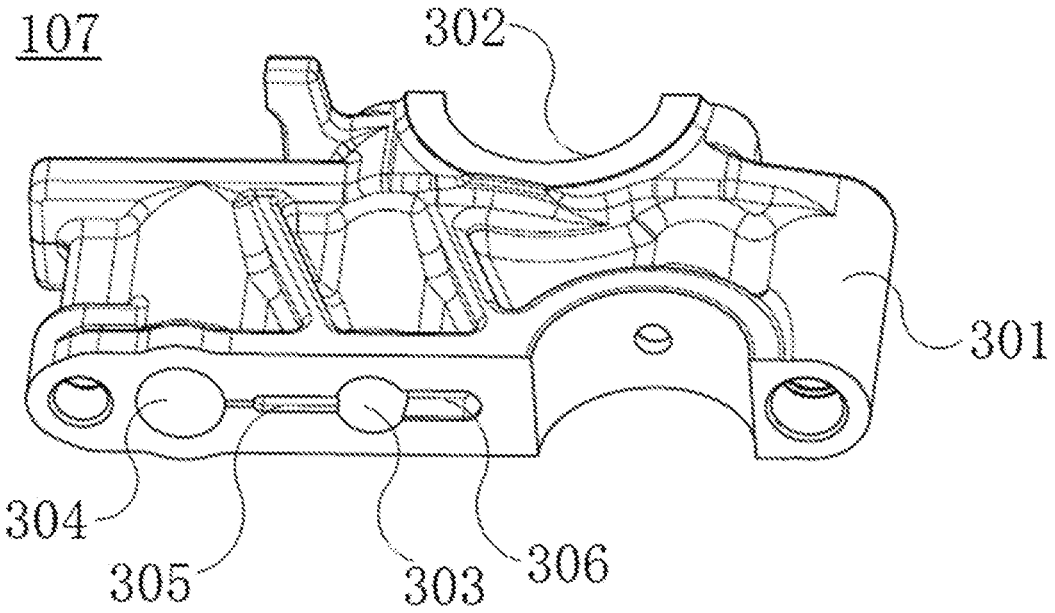
FIG. 4 is a schematic structural diagram of a supporting base according to an embodiment of the present application.

As shown in FIG. 4, the supporting base 107 may include a base body 301 and a base-body camshaft supporting portion 302. The base body 301 may be provided with a base-body via hole, and fixed on the cylinder head 117 of the engine by a bolt which passes through the base-body via hole, and the base-body camshaft supporting portion 302 may be provided on the base body 301, for supporting the camshaft 101.

As shown in FIG. 4, the supporting base 107 may be communicated with the cylinder head 117, and provided with a first supporting-base oil feeding passage 304 and a second supporting-base oil feeding passage 303, which are communicated with a cylinder head oil passage 401 in the cylinder head 117 separately. Further, the first supporting-base oil feeding passage 304 may be communicated with the connecting-portion via hole 204, and an upper end of the second supporting-base oil feeding passage 303 may extend to the base-body camshaft supporting portion 302, so as to output the lubricating oil to the camshaft 101.

Thus, a part of the lubricating oil in the cylinder head oil passage 401 may flow upwards to the connecting-portion via hole 204 in the fixed support 108 from the first supporting-base oil feeding passage 304, and further flows into the intermediate swing arm shaft hole 203 through the oil passage 205, to lubricate the intermediate swing arm shaft 114. Another part of the lubricating oil in the cylinder head oil passage 401 may flow upwards to the base-body camshaft supporting portion 302 from the second supporting-base oil feeding passage 303, thereby lubricating the camshaft 101 supported on the base-body camshaft supporting portion 302.

In the valve mechanism 1000 according to the present application, by providing the first supporting-base oil feeding passage 304 and the second supporting-base oil feeding passage 303, the lubricating oil may flow to the intermediate swing arm shaft 114 through the first supporting-base oil feeding passage 304 and to the camshaft 101 through the second supporting-base oil feeding passage 303, thereby lubricating the intermediate swing arm shaft 114 and the camshaft 104, and guaranteeing smooth work of the valve mechanism 1000.

Figure 5:
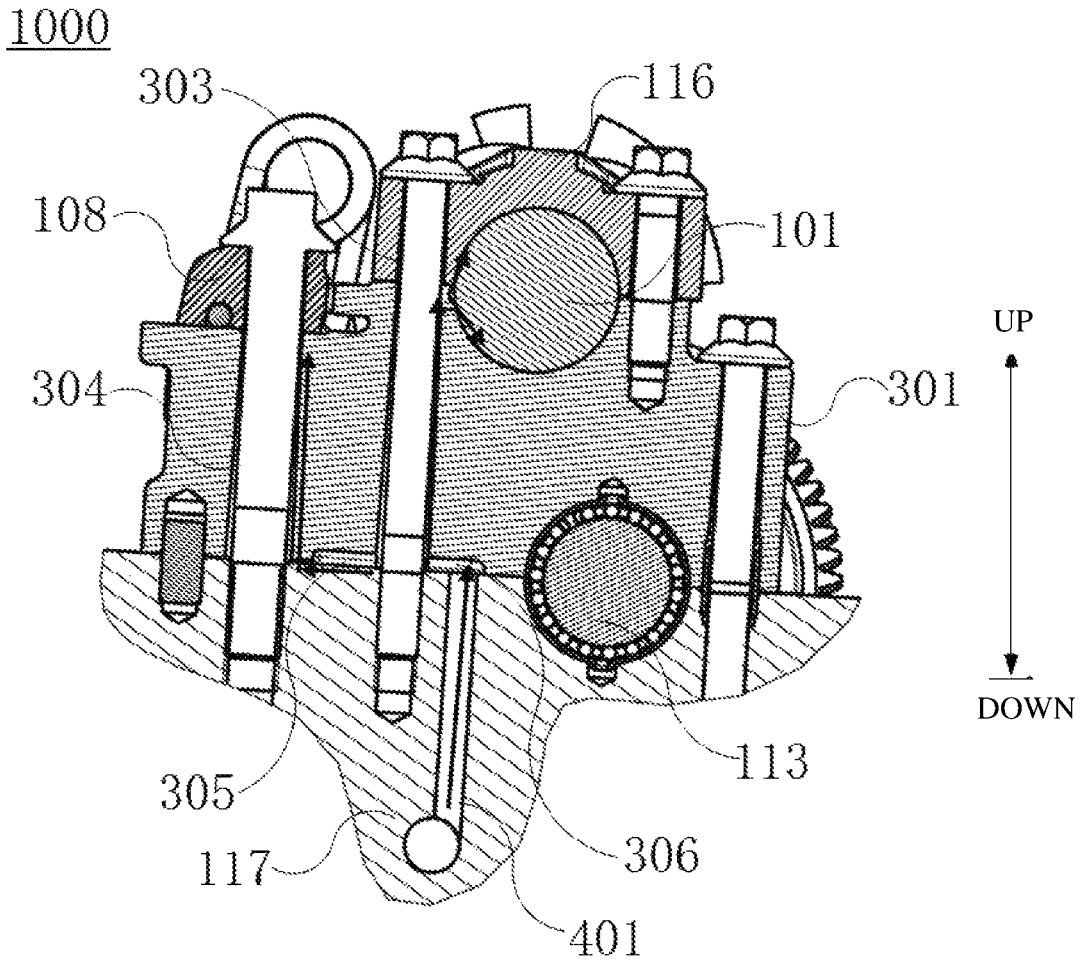
FIG. 5 is a schematic diagram showing flow of the lubricating oil in a supporting base according to an embodiment of the present application.

Further, as shown in FIGS. 4 and 5, bottom surface oil passages (305, 306) may be defined in a bottom surface of the supporting base 107, and communicated with the first supporting-base oil feeding passage 304 and the second supporting-base oil feeding passage 303. Thus, the lubricating oil from the cylinder head oil passage 401 may be split by the bottom surface oil passage.

Further, as shown in FIG. 5, the bottom surface oil passage may include a first bottom surface oil passage 305 and a second bottom surface oil passage 306. An inlet end (right end in FIG. 4) of the first bottom surface oil passage 305 may be connected with a lower end of the second supporting-base oil feeding passage 303, and an outlet end (left end in FIG. 4) of the first bottom surface oil passage 305 may be connected with the first supporting-base oil feeding passage 304. An inlet end (right end in FIG. 4) of the second bottom surface oil passage 306 may be communicated with the cylinder head oil passage 401, and an outlet end (left end in FIG. 4) of the second bottom surface oil passage 306 is communicated with the lower end of the second supporting-base oil feeding passage 303.

Further, as shown in FIG. 5, the first bottom surface oil passage 305 may be configured as a limiting oil passage with respect to the second bottom surface oil passage 306. In some more specific embodiments, the first bottom surface oil passage 305 may be configured as a stepped limiting oil passage with a decreasing flow section, and has a gradually smaller flow section when nearing the first supporting-base oil feeding passage 304, such that the lubricating oil which flows into the first supporting-base oil feeding passage 304 may have a relatively high flowing pressure, and is guaranteed to have a sufficient pressure to flow to a junction between the oil passage 205 and the first supporting-base oil feeding passage 304.

Further, as shown in FIG. 5, the base-body via hole may include a first base-body via hole aligned with the connecting-portion via hole 204, and a bolt may pass through the connecting-portion via hole 204 and the first base-body via hole successively, so as to fix the fixed support 108 and the supporting base 107 on the cylinder head 117. A gap between the first base-body via hole and the bolt which passes through the first base-body via hole may serve as the first supporting-base oil feeding passage 304, and the connecting-portion via hole 204 may be in clearance fit with the bolt.

Figure 6:
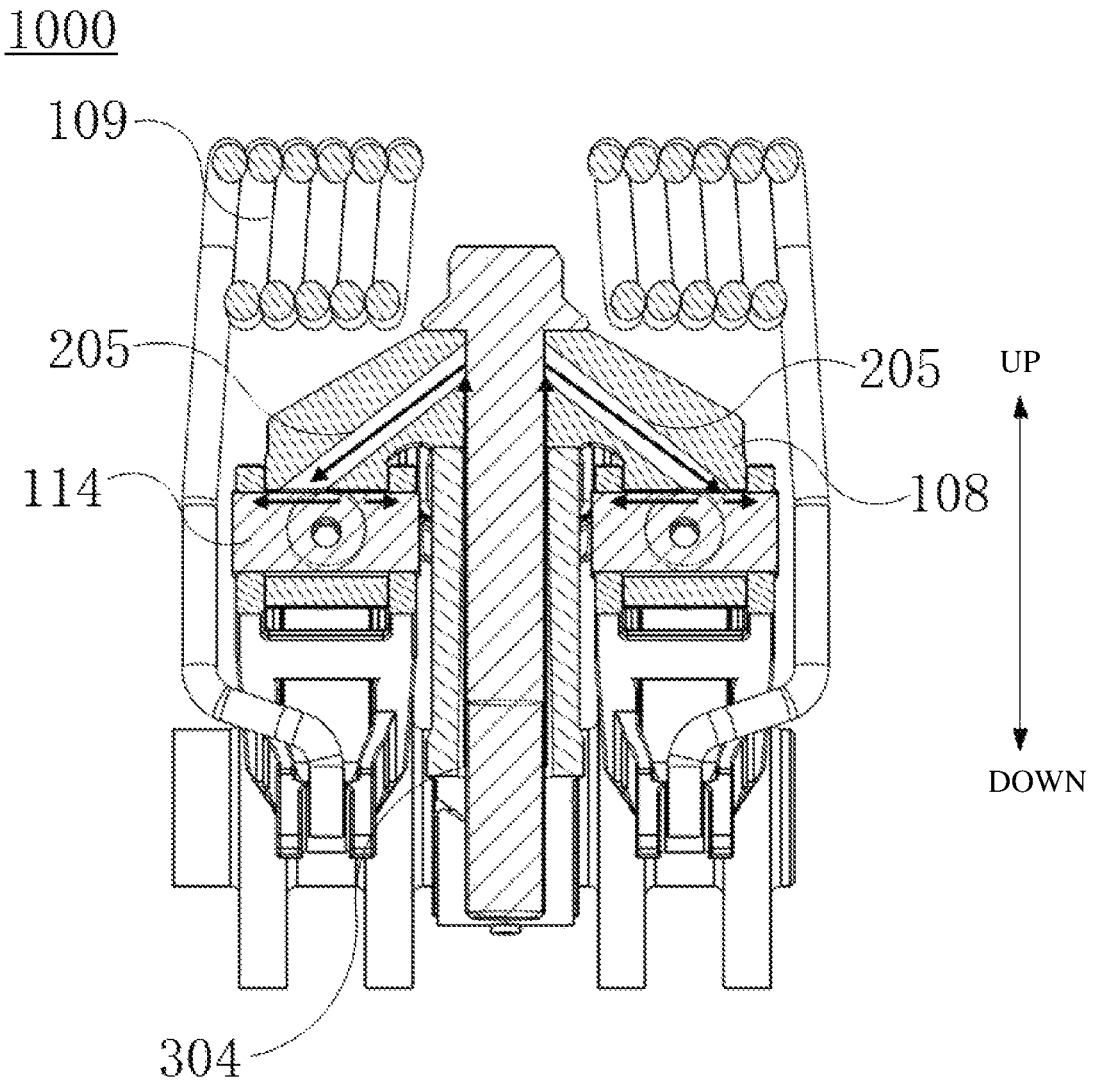
FIG. 6 is a schematic diagram showing flow of the lubricating oil in a fixed support according to an embodiment of the present application.

Further, as shown in FIGS. 5 and 6, the base-body via hole may further include a second base-body via hole, a camshaft gland 116 may be provided on the supporting base 107, the camshaft 101 may be cooperatively supported by the camshaft gland 116 and the base-body camshaft supporting portion 302, the second base-body via hole may be fixed on the cylinder head 117 by another bolt which passes through the camshaft gland 116 and the second base-body via hole, and a gap between the second base-body via hole and the another bolt may serve as the second supporting-base oil feeding passage 303.

Further, as shown in FIG. 7, each oil passage 205 may be located above the corresponding intermediate swing arm shaft hole 203, and the two oil passages 205 may be arranged obliquely relative to the connecting-portion via hole 204. Thus, the lubricating oil may flow more smoothly to the intermediate swing arm shaft hole 203 from the connecting-portion via hole 204 through the oil passage 205 under its own gravity.

Further, as shown in FIG. 3, the connecting portion 201 may have a front surface and a rear surface, the front surface of the connecting portion 201 may be provided with a spring limiting plate 206 which extends forwards, and a spring limiting groove 207 may be defined between the spring limiting plate 206 and the front surface of the connecting portion 201, open downwards and closed by an upper surface of the supporting base 107. Thus, the elastic restoring device 109 may be fixed in the spring limiting groove 207 and abuts against the intermediate swing arm 106 elastically, thereby keeping the cam 102, the lift regulating eccentric wheel 113 and the intermediate swing arm roller 115 of the valve mechanism 1000 attached and in contact all the time.

Further, as shown in FIG. 3, the connecting portion 201 may be connected between top surfaces of the two fixed portions 202, the two fixed portions 202 may be spaced apart in an axial direction of the intermediate swing arm shaft 114, and the supporting base 107 may be located between the two fixed portions 202. Thus, the valve mechanism 1000 has a more compact structure.

The engine according to the present application will be described below.

The engine according to the embodiment of the present application includes the valve mechanism 1000 according to any of the above-mentioned embodiments.

In the engine according to the present application, normal work of the engine is facilitated by providing the valve mechanism 1000.

The vehicle according to the present application will be described below.

The vehicle according to the embodiment of the present application includes the engine according to the above-mentioned embodiments.

In the vehicle according to the present application, normal travel of the vehicle is facilitated by providing the engine.

The above are merely the preferred embodiments of the present application and shall not be used to limit the present application. Any modifications, equivalents and improvements made within the spirit and principle of the present application shall fall within the protection scope of the present application.

What is claimed is:

1. A valve mechanism, comprising:

a valve having a valve roller;

a camshaft provided with a cam;

a fixed support comprising a fixed portion and a connecting portion, the connecting portion being connected with the fixed portion, and provided with a connecting-portion via hole running from top to bottom, and the connection portion defining an oil passage therein;

an intermediate swing arm located between the cam and the valve, the cam driving the valve to move by means of the intermediate swing arm swinging around an intermediate swing arm shaft mounted in the fixed portion, and the oil passage being connected with the connecting-portion via hole and configured to output lubricating oil to the intermediate swing arm shaft;

a supporting base comprising a base body and a base-body camshaft supporting portion configured to support the camshaft; and wherein the supporting base defines a first supporting-base oil feeding passage and a second supporting-base oil feeding passage therein, the first supporting-base oil feeding passage is communicated with the connecting-portion via hole, and an upper end of the second supporting-base oil feeding passage extends to the base-body camshaft supporting portion, so as to output the lubricating oil to the camshaft.

2. The valve mechanism according to claim 1, wherein a bottom surface oil passage is defined in a bottom surface of the supporting base and communicated with the first supporting-base oil feeding passage and the second supporting-base oil feeding passage.

3. The valve mechanism according to claim 2, wherein the bottom surface oil passage comprises:

a first bottom surface oil passage and a second bottom surface oil passage, the first bottom surface oil passage has an inlet end connected with a lower end of the second supporting-base oil feeding passage and an outlet end connected with the first supporting-base oil feeding passage, and the second bottom surface oil passage has an inlet end adapted to be communicated with a cylinder head oil passage and an outlet end communicated with the lower end of the second supporting-base oil feeding passage.

4. The valve mechanism according to claim 3, wherein the first bottom surface oil passage is configured as a limiting oil passage with respect to the second bottom surface oil passage.

5. The valve mechanism according to claim 4, wherein the first bottom surface oil passage is configured as a stepped limiting oil passage with a decreasing flow section, and has a gradually smaller flow section when nearing the first supporting-base oil feeding passage.

6. The valve mechanism according to claim 1, wherein the base body is provided with a base-body via hole therein, and the base body is adapted to be fixed on a cylinder head of an engine by a bolt passing through the base-body via hole, and the base-body via hole comprises a first base-body via hole aligned with the connecting-portion via hole, such that the fixed support and the supporting base are fixed on the cylinder head by a bolt passing through the connecting-portion via hole and the first base-body via hole successively; a gap between the first base-body via hole and the bolt passing through the first base-body via hole serves as the first supporting-base oil feeding passage, and the connecting-portion via hole is in clearance fit with the bolt.

7. The valve mechanism according to claim 6, wherein the base-body via hole further comprises a second base-body via hole, a camshaft gland is provided on the supporting base, the camshaft is cooperatively supported by the camshaft gland and the base-body camshaft supporting portion, the supporting base is adapted to be fixed on the cylinder head by another bolt passing through the camshaft gland and the second base-body via hole, and a gap between the second base-body via hole and the another bolt serves as the second supporting-base oil feeding passage.

8. The valve mechanism according to claim 1, wherein two fixed portions are provided and connected with each other by the connecting-portion, the fixed portion defines an intermediate swing arm shaft hole therein, and the intermediate swing arm shaft is mounted in the intermediate swing arm shaft hole; two oil passages are provided, each of the two oil passages is located above the corresponding intermediate swing arm shaft hole, and the two oil passages are arranged obliquely relative to the connecting-portion via hole.

9. The valve mechanism according to claim 1, wherein the connecting portion has a front surface and a rear surface, the front surface of the connecting portion is provided with a spring limiting plate extending forwards, and a spring limiting groove is defined between the spring limiting plate and the front surface of the connecting portion, open downwards and closed by an upper surface of the supporting base.

10. The valve mechanism according to claim 1, wherein the connecting portion is connected between top surfaces of the two fixed portions, the two fixed portions are spaced apart axially, and the supporting base is located between the two fixed portions.

11. The valve mechanism according to claim 2, wherein the base body is provided with a base-body via hole therein, and the base body is adapted to be fixed on a cylinder head of an engine by a bolt passing through the base-body via hole, and the base-body via hole comprises a first base-body via hole aligned with the connecting-portion via hole, such that the fixed support and the supporting base are fixed on the cylinder head by a bolt passing through the connecting-portion via hole and the first base-body via hole successively; a gap between the first base-body via hole and the bolt passing through the first base-body via hole serves as the first supporting-base oil feeding passage, and the connecting-portion via hole is in clearance fit with the bolt.

12. The valve mechanism according to claim 3, wherein the base body is provided with a base-body via hole therein, and the base body is adapted to be fixed on a cylinder head of an engine by a bolt passing through the base-body via hole, and the base-body via hole comprises a first base-body via hole aligned with the connecting-portion via hole, such that the fixed support and the supporting base are fixed on the cylinder head by a bolt passing through the connecting-portion via hole and the first base-body via hole successively; a gap between the first base-body via hole and the bolt passing through the first base-body via hole serves as the first supporting-base oil feeding passage, and the connecting-portion via hole is in clearance fit with the bolt.

13. The valve mechanism according to claim 2, wherein two fixed portions are provided and connected with each other by the connecting-portion, the fixed portion defines an intermediate swing arm shaft hole therein, and the intermediate swing arm shaft is mounted in the intermediate swing arm shaft hole; two oil passages are provided, each of the two oil passages is located above the corresponding intermediate swing arm shaft hole, and the two oil passages are arranged obliquely relative to the connecting-portion via hole.

14. The valve mechanism according to claim 3, wherein two fixed portions are provided and connected with each other by the connecting-portion, the fixed portion defines an intermediate swing arm shaft hole therein, and the intermediate swing arm shaft is mounted in the intermediate swing arm shaft hole; two oil passages are provided, each of the two oil passages is located above the corresponding intermediate swing arm shaft hole, and the two oil passages are arranged obliquely relative to the connecting-portion via hole.

15. The valve mechanism according to claim 2, wherein the connecting portion has a front surface and a rear surface, the front surface of the connecting portion is provided with a spring limiting plate extending forwards, and a spring limiting groove is defined between the spring limiting plate and the front surface of the connecting portion, open downwards and closed by an upper surface of the supporting base.

16. The valve mechanism according to claim 3, wherein the connecting portion has a front surface and a rear surface, the front surface of the connecting portion is provided with a spring limiting plate extending forwards, and a spring limiting groove is defined between the spring limiting plate and the front surface of the connecting portion, open downwards and closed by an upper surface of the supporting base.

17. The valve mechanism according to claim 2, wherein the connecting portion is connected between top surfaces of the two fixed portions, the two fixed portions are spaced apart axially, and the supporting base is located between the two fixed portions.

18. The valve mechanism according to claim 3, wherein the connecting portion is connected between top surfaces of the two fixed portions, the two fixed portions are spaced apart axially, and the supporting base is located between the two fixed portions.

19. An engine, comprising a valve mechanism comprising:

a valve having a valve roller;

a camshaft provided with a cam;

a fixed support comprising a fixed portion and a connecting portion, the connecting portion being connected with the fixed portion, and provided with a connecting-portion via hole running from top to bottom, and the connection portion defining an oil passage therein;

an intermediate swing arm located between the cam and the valve, the cam driving the valve to move by means of the intermediate swing arm swinging around an intermediate swing arm shaft mounted in the fixed portion, and the oil passage being connected with the connecting-portion via hole and configured to output lubricating oil to the intermediate swing arm shaft;

a supporting base comprising a base body and a base-body camshaft supporting portion configured to support the camshaft; and wherein the supporting base defines a first supporting-base oil feeding passage and a second supporting-base oil feeding passage therein, the first supporting-base oil feeding passage is communicated with the connecting-portion via hole, and an upper end of the second supporting-base oil feeding passage extends to the base-body camshaft supporting portion, so as to output the lubricating oil to the camshaft.

20. A vehicle, comprising:

an engine comprising a valve mechanism comprising:

a valve having a valve roller;

a camshaft provided with a cam;

a fixed support comprising a fixed portion and a connecting portion, the connecting portion being connected with the fixed portion, and provided with a connecting-portion via hole running from top to bottom, and the connection portion defining an oil passage therein;

an intermediate swing arm located between the cam and the valve, the cam driving the valve to move by means of the intermediate swing arm swinging around an intermediate swing arm shaft mounted in the fixed portion, and the oil passage being connected with the connecting-portion via hole and configured to output lubricating oil to the intermediate swing arm shaft;

a supporting base comprising a base body and a base-body camshaft supporting portion configured to support the camshaft; and wherein the supporting base defines a first supporting-base oil feeding passage and a second supporting-base oil feeding passage therein, the first supporting-base oil feeding passage is communicated with the connecting-portion via hole, and an upper end of the second supporting-base oil feeding passage extends to the base-body camshaft supporting portion, so as to output the lubricating oil to the camshaft.

* * * * *